US008708722B1

(12) United States Patent
Walliser et al.

(10) Patent No.: US 8,708,722 B1
(45) Date of Patent: Apr. 29, 2014

(54) POWER ADAPTER WITH INTERCHANGEABLE HEADS

(75) Inventors: Marc Rene Walliser, San Francisco, CA (US); Emmanuel J M Laffon de Mazieres, Burlingame, CA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 13/614,799

(22) Filed: Sep. 13, 2012

(51) Int. Cl.
*H01R 29/00* (2006.01)

(52) U.S. Cl.
USPC ..... 439/172; 439/337

(58) Field of Classification Search
USPC ..... 439/106, 222, 166, 171, 649, 653, 172, 439/333, 337, 518
See application file for complete search history.

(56) References Cited

U.S. PATENT DOCUMENTS 1,658,583 A * 2/1928 Wells ..... 439/333
2,127,473 A * 8/1938 Sacco ..... 439/616
6,328,581 B1 * 12/2001 Lee et al. ..... 439/106
6,492,590 B1 * 12/2002 Cheng ..... 174/50
6,845,023 B2 * 1/2005 Philips et al. ..... 363/132
7,632,119 B1 * 12/2009 Ma et al. ..... 439/172
7,632,137 B1 * 12/2009 Ma et al. ..... 439/518
7,946,868 B1 * 5/2011 Chen ..... 439/173
8,033,847 B1 * 10/2011 Chen ..... 439/172
8,197,260 B2 * 6/2012 Wadsworth ..... 439/27
8,308,496 B2 * 11/2012 Youssefi-Shams et al. ... 439/172
8,313,350 B2 * 11/2012 Lee ..... 439/651
8,480,418 B2 * 7/2013 Youssefi-Shams et al. ... 439/172

* cited by examiner

*Primary Examiner* — Neil Abrams
*Assistant Examiner* — Phuong T Nguyen
(74) *Attorney, Agent, or Firm* — Lowenstein Sandler LLP

(57) ABSTRACT

A power adapter has a cable port disposed on one side and a power conversion circuit to convert an input power from an alternating current (AC) power system to an output power used by a device coupled to the cable port. The power adapter further includes electrical contacts coupled to the power conversion circuit and locking columns disposed within a recessed cylindrical portion of a housing. An interchangeable head having prongs protruding from a surface couples to the electrical contacts of the power adapter to provide the input power to the power conversion circuit. A cylindrical body fits within the cylindrical housing in an assembly position, and includes locking tabs to engage the locking columns when the interchangeable head is rotated in a first direction into a first locking position and in a second direction into a second locking position.

20 Claims, 7 Drawing Sheets

POWER ADAPTER WITH INTERCHANGEABLE HEADS

BACKGROUND

Many consumer electronic devices (e.g., tablet computers, smartphones, etc.) or other devices, are powered by (or include a battery which may be charged by) an alternating current (AC) power adapter or power converter. An AC power adapter is a type of eternal power supply that plugs into a power outlet (e.g., a wall outlet) and is used to provide the device with power from the power outlet. AC power adapters are often used with devices that do not contain internal components to derive the required voltage and power from the AC power at the outlet. AC power adapters are used both with devices with no other source of power, and with battery-powered devices, where the AC power adapter, when plugged in, can sometimes charge the battery in addition to powering the device.

AC power adapters generally include prongs that plug into the power outlet to obtain the AC power. Different countries and regions have differently styled power outlets that require a specific prong design. For example, North America, Europe, the United Kingdom, and Australia all have different styled prongs. Thus, in order for a user to be able to use an electronic device while traveling between these different regions, the user may be required to carry multiple different AC power adapters. Carrying these extra accessories around with the device can be burdensome and inconvenient for the user.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 2:
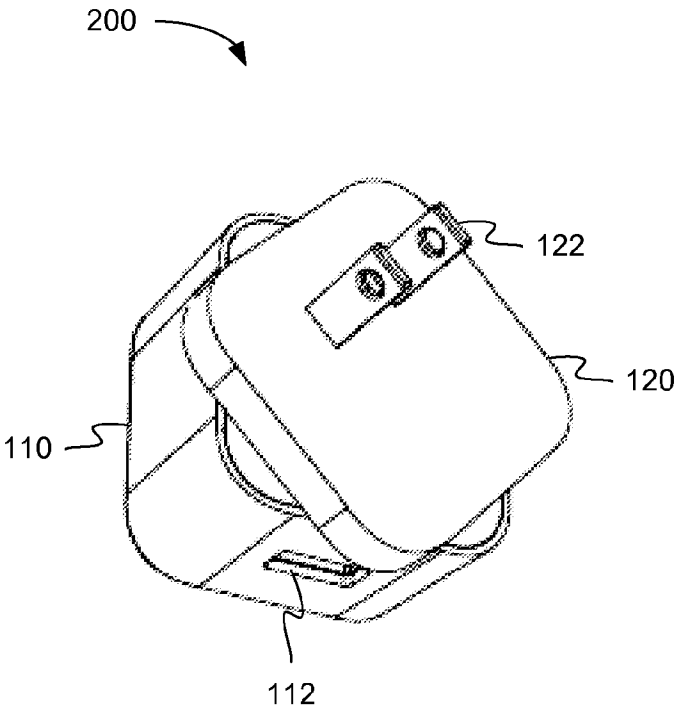
FIG. 2 is a diagram illustrating a power adapter with interchangeable heads, according to an embodiment.

The following description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of the present invention.

Embodiments of an apparatus and method are described for a power adapter with interchangeable or removable heads. To accommodate the electrical power outlet systems of different countries and regions, the interchangeable heads may be swapped for one another so that when traveling, a user need only carry one power adapter rather than several completely different adapter platforms. For example, when in North America, the user may attach a North America specific interchangeable head with prongs designed to work with power outlets in North America. Upon traveling to Europe, for example, the user may remove the North America specific interchangeable head and attach a Europe specific interchangeable head with prongs designed to work with power outlets in Europe.

In addition, all of the interchangeable heads may be rotatable so that prongs on the interchangeable heads may be oriented in multiple different directions in relation to the power adapter. Specifically, the power adapter may have a cable port on one side, where a cable, such as a Universal Serial Bus (USB) cable, may be connected in order to provide power to an electronic device. In another embodiment, the cable may be permanently attached to one side of the power adapter. An interface between the power adapter and the interchangeable heads allows the interchangeable heads to be connected with the prongs oriented in at least four directions (e.g., the cable or cable port points "up," "down," "left," or "right). In this example the four directions are driven by the approximately square footprint of the adapter. In other embodiments, however, depending on the actual shape of the adapter, a potentially unlimited number of positions for the orientation between the cable and the prongs of the interchangeable adapter should be achievable (e.g. round footprint of power adapter).

Having interchangeable adapters for different countries or regions allows a user to easily charge an electronic device even if different power outlet systems are used. The interchangeable adapters also prevent the user from having to travel with a number of different complete power adapters. The rotational nature of the interchangeable heads, allowing for different orientations relative to the cable or cable port, is beneficial for accommodating power outlets with space constraints. For example, when a user tries to place several plugs next to one another or on a multi-outlet power strip, being able to select the direction of the cable exit may be convenient. A fixed orientation could cause the cable to interfere with or overlap adjacent outlets. The multiple orientations avoid this interference and possible damage to the cable, which may result in an optimized user experience and high consumer satisfaction.

Figure 1:
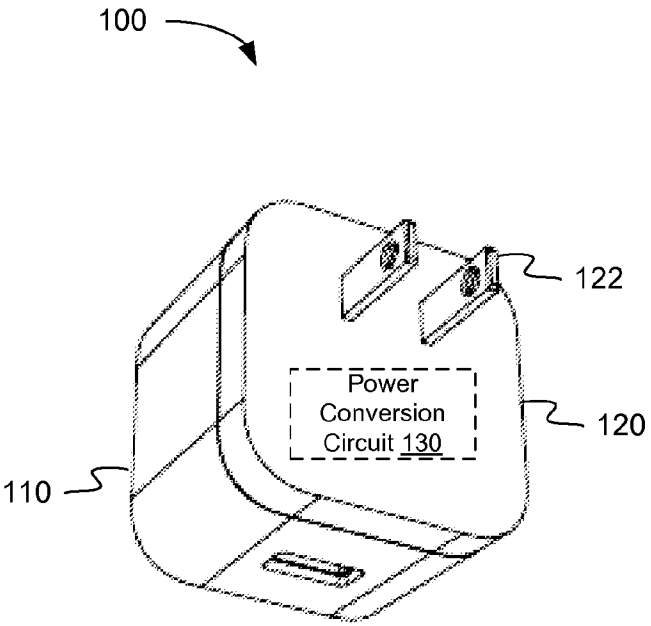
FIG. 1 is a diagram illustrating a power adapter with interchangeable heads, according to an embodiment.

FIG. 1 is a diagram illustrating a power adapter with interchangeable heads, according to an embodiment. In one embodiment, the apparatus 100 includes power adapter 110 and interchangeable head 120. Power adapter 110 may be, for example, an alternating current (AC) power adapter used to provide power to an electronic device, such as a tablet computer, electronic book reader, smartphone, or other device. In other embodiments, power adapter 110 may be referred to as a power converter. Power adapter 110 may include a power conversion circuit 130 designed to receive wall power, for example, from a power outlet in the wall and convert that wall power to the voltage and power used by the electronic device. In one embodiment, the wall power may be power from one of several AC power systems. For example, different countries may have different AC power systems. Power conversion circuit 130 may convert the power from any of these AC power systems to the power used by the electronic device. Power adapter 110 may be used for an electronic device that does not contain internal components to derive the proper voltage and power from the wall power at the outlet. Power adapter 110 may be used with an electronic device that has no other source of power, or with a battery-powered device, wherein power adapter 110 may be used to charge the battery instead of or in addition to powering the device. Power conversion circuit 130 may be internal to power adapter 110.

Interchangeable head 120 is connected to power adapter 110 to obtain the wall power from a power outlet. Interchangeable head 120 will generally include one or more prongs or a set of prongs 122 that may be inserted into an outlet to form an electrical connection and receive the wall power. An interface used to connect the interchangeable head 120 and power adapter 110 (not shown, but described in detail below), allows the wall power to pass from the prongs 122 of interchangeable head 120 to power adapter 110, so that the wall power may be converted to the power and voltage used by the electronic device, as described above.

FIG. 2 is a diagram illustrating a power adapter with interchangeable heads, according to an embodiment. In one embodiment, the apparatus 200 illustrates the rotation of interchangeable head 120. In one embodiment, interchangeable head 120 may be attached to power adapter 110 at an off-angle with respect to the footprint of power adapter 110 and rotated, for example, by a one eighth turn (i.e., 45 degrees), a one quarter turn (i.e., 90 degrees), or some other amount, in order to lock the interchangeable head 120 into place. In one embodiment, the footprint of interchangeable head 122 may approximately overlap the footprint power adapter 110 when locked into place. In another embodiment, interchangeable head 120 may be freely rotatable in either direction (e.g., 90 degrees or 180 degrees at a time) while attached to power adapter 110 to change the orientation of prongs 122 with respect to power adapter 110.

Power adapter 110 may include cable port 112. In one embodiment, cable port 112 may be a port where a power or data cable may be attached. Cable port 112 may have a certain type of connector, such as for example, USB, mini-USB, micro-USB, FireWire, Ethernet, or some other type of connector. In another embodiment, rather than a cable port 112, power adapter 110 may include a fixed cable or power cord. The rotation of interchangeable head 120 allows for a variety of different orientations for the prongs 122 of interchangeable head 120 with respect to power adapter 110, and in particular with respect to cable port 112. For example, in FIG. 2, interchangeable head 120 is attached to power adapter 110 at an off-angle with respect to the footprint of power adapter 110. If interchangeable head 120 is rotated 45 degrees clockwise and locked into place, cable port 112 would be located on the bottom of apparatus 200. However, if interchangeable head 120 is rotated 45 degrees counterclockwise and locked into place, cable port 112 would be located on the side of apparatus 200 (relative to the orientation of prongs 122). In this manner, the power cable connected to an electronic device may be adjusted so as not to be damaged or interfere with adjacent power outlets.

Figure 3:
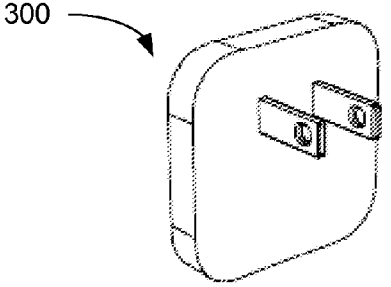
FIG. 3 is a diagram illustrating an interchangeable head for North America for use with a power adapter, according to an embodiment.
Figure 4:
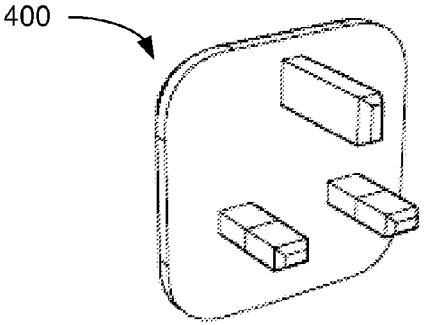
FIG. 4 is a diagram illustrating an interchangeable head for the United Kingdom for use with a power adapter, according to an embodiment.
Figure 5:
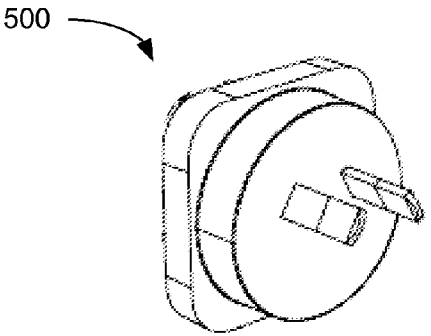
FIG. 5 is a diagram illustrating an interchangeable head for Australia for use with a power adapter, according to an embodiment.
Figure 6:
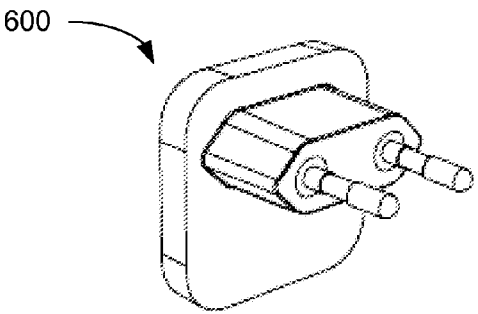
FIG. 6 is a diagram illustrating an interchangeable head for Europe for use with a power adapter, according to an embodiment.

FIGS. 3-6 illustrate various interchangeable heads that may be used in connection with a power adapter, such as power adapter 110, depending on the wall socket system in a given country or region. Each of the interchangeable heads may include an interface (not shown) to connect with power adapter 110, as described above. FIG. 3 is a diagram illustrating an interchangeable head 300 for North America or China (if holes in prongs are absent) for use with a power adapter, according to an embodiment. FIG. 4 is a diagram illustrating an interchangeable head 400 for the United Kingdom for use with a power adapter, according to an embodiment. FIG. 5 is a diagram illustrating an interchangeable head 500 for Australia for use with a power adapter, according to an embodiment. FIG. 6 is a diagram illustrating an interchangeable head 600 for Europe or Brazil for use with a power adapter, according to an embodiment.

Figure 7:
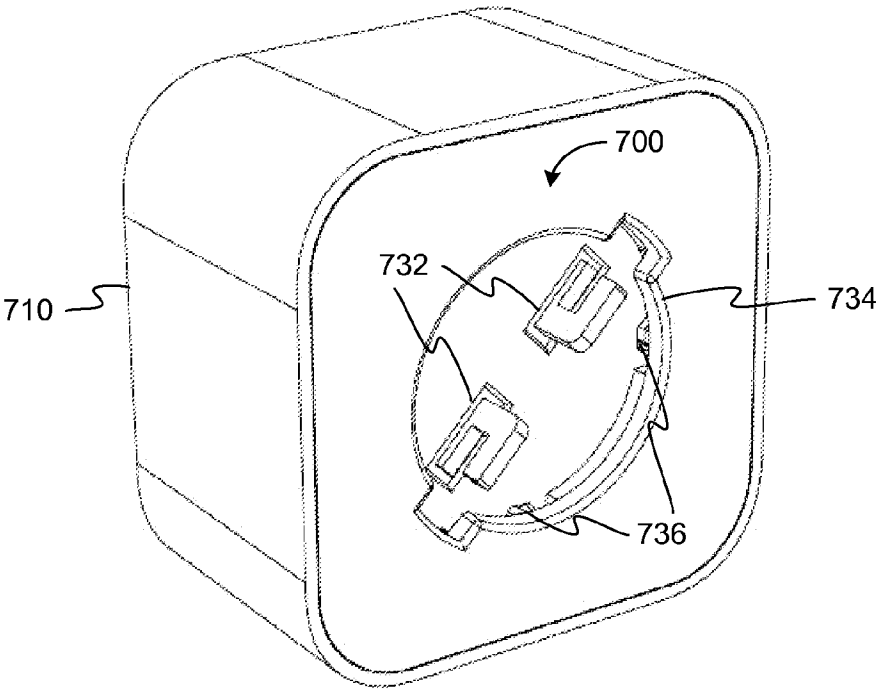
FIG. 7 is a diagram illustrating an interface on a power adapter for connecting the power adapter to an interchangeable head, according to an embodiment.

FIG. 7 is a diagram illustrating an interface 700 on a power adapter 710 for connecting the power adapter 710 to an interchangeable head, according to an embodiment. In one embodiment, the interface 700 includes a set of one or more electrical contacts 732, a geometric housing 734 and one or more locking components 736.

Figure 8:
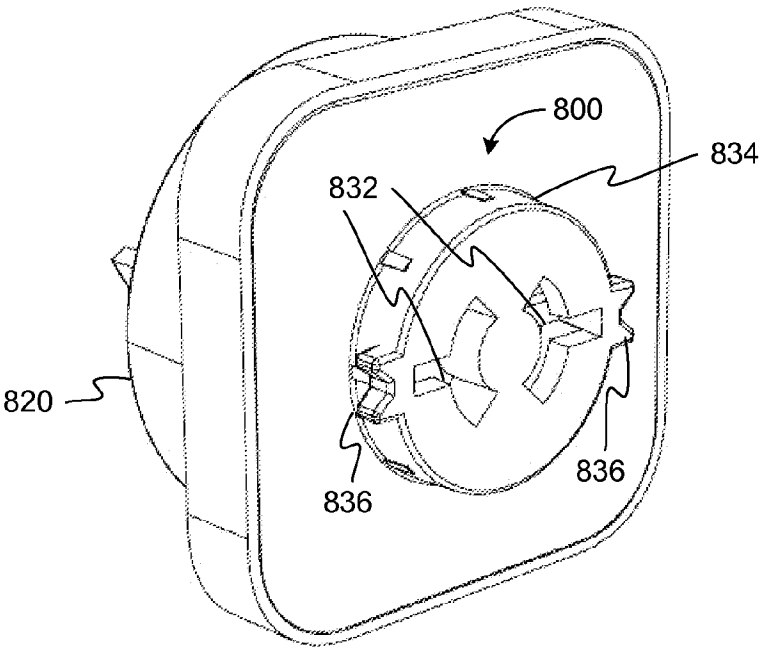
FIG. 8 is a diagram illustrating an interface on an interchangeable head for connecting the interchangeable head to a power adapter, according to an embodiment.

FIG. 8 is a diagram illustrating an interface 800 on an interchangeable head 820 for connecting the interchangeable head 820 to a power adapter, according to an embodiment. In one embodiment, the interface 800 includes a set of one or more electrical contacts 832, a geometric housing 834 and one or more locking components 836.

Referring to both FIGS. 7 and 8, in one embodiment, the interface 700 of power adapter 710 is used to connect with the interface 800 of interchangeable head 820. In one embodiment, electrical contacts 732 and 832 form an electrical connection to transfer wall power received by the set of prongs on interchangeable head 820 from a power outlet to power adapter 710 for conversion to the power level used by a connected electronic device. Electrical contacts 732 on power adapter 710 may be exposed contacts formed from a metal or other conductive material. In one embodiment, electrical contacts 732 may have a substantially hooked or "L" shape to enable contact with electrical contacts 832. The "L" shape allows the electrical contacts 732 to fit through a gap in the surface of geometric housing and 834 and rotate in either the clockwise or counter-clockwise direction to contact electrical contacts 832. Electrical contacts 832 on interchangeable head 820 may be disposed within geometric housing 834, and may be formed from a metal or other conductive material. In one embodiment, electrical contacts 832 may have a substantially flat or planar shape to enable contact with electrical contacts 732. The electrical contacts 832 may be recessed within geometric housing 834 for safety reasons to prevent accidental electrocution. The "L" shape of electrical contacts 732 allows them to fit within a gap or hole in the surface of geometric housing 834 in order to contact electrical contacts 832, which are disposed beneath the surface of geometric housing 834. The "L" shape allows the electrical contacts 732 to contact electrical contacts 832, while the shape of the hole or gap though the geometric housing 834 prevents other objects, such as a user's finger, from making direct contact with electrical contacts 832. In other embodiments, electrical contacts 732 and 832 may have different shapes, be disposed in different locations, or be formed from different materials.

Geometric housings 734 and 834 serve to properly align electrical contacts 732 and 832 in order to form the electrical connection. In one embodiment, geometric housing 734 is a shallow substantially cylindrical void in the front surface of power adapter 710 and geometric housing 834 is a substantially cylindrical body protruding from the back surface of interchangeable head 820. The cylindrical void may be referred to as a female portion of the housing and the cylindrical body may be referred to as a male portion of the housing. As described above, in one embodiment, geometric housing 834 may have one or more gaps or holes within the surface to accommodate electrical contacts 732 from power adapter 710. In one embodiment, the cylindrical void of geometric housing 734 has one or more notches in the side used to align one or more locking tabs of locking component 836 on interchangeable head 820. The notches effectively limit the orientations in which geometric housing 834 may fit into geometric housing 734. In other embodiments, the notches are not present and the cylindrical void of geometric housing 734 is substantially uniform at the top surface. In this case, there is no limit to the different orientations in which geometric housing 834 may fit into geometric housing 734. In other embodiments, geometric housings 734 and 834 may have some other shape and/or orientation within power adapter 710 and interchangeable head 820, respectively.

Locking components 736 and 836 secure power adapter 710 and interchangeable head 820 together, when connected. In one embodiment, locking component 736 includes one or more spring loaded locking columns disposed within the cylindrical void of geometric housing 734. The locking columns may be, for example, substantially cylindrical in shape and may be pressed, by the spring, towards the center of geometric housing 734. In other embodiments, the locking columns may not be spring loaded. For example, the locking columns may be formed from a flexible material (e.g., plastic). These locking columns may be able to be bent back from an original position to allow them to engage with locking components 836 and may have a force applied toward the center of geometric housing 734 that causes the locking columns to return to their original position. Locking component 836 of interchangeable adapter 820 may include one or more locking tabs extending from the cylindrical body of geometric housing 834. The locking tabs may be, for example, semicircular in shape to allow them to engage the locking columns on power adapter 710. The locking tabs may press against the locking columns, overcoming the force of the spring, until the cylindrical locking column comes to rest within the semicircular locking tab. The force of the spring may press the locking column into the locking tab, holding the interchangeable head 820 in place on the power adapter 710. In one embodiment, the number of locking tabs on locking component 836 may be the same has the number of locking columns in locking component 736. In other embodiments, however, there may be fewer locking tabs than locking columns (e.g., to account for the either clockwise or counterclockwise turn of interchangeable head 820). As described above, when geometric housing 834 is inserted into geometric housing 734, the locking tabs of locking component 836 may fit into the notches of geometric housing 734. As interchangeable head 820 is rotated either clockwise or counterclockwise, upon reaching a stopping point (e.g., a rotation of 45 degrees), the locking tabs of locking component 836 may engage the spring loaded locking columns of locking component 736. Thus, interchangeable head 820 may be rotated in a first direction (e.g., clockwise) into a first locking position or in a second direction (e.g., counterclockwise) into a second locking position, without being removed from power adapter 710. The spring loaded locking columns of locking component 736 may hold the locking tabs of locking component 836 in place, thereby securing interchangeable head 820 in place, until a sufficient force is applied to overcome the springs. In other embodiments, locking components 736 and 836 may take other forms, be disposed in other locations, or otherwise secure interchangeable head 820 to power adapter 710.

Figure 10:
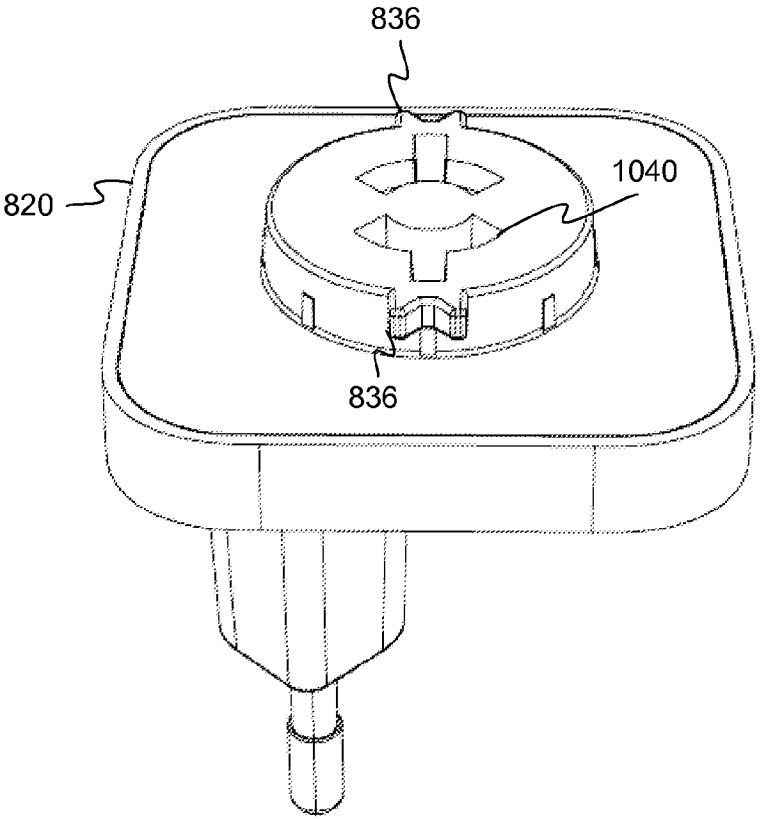
FIG. 10 is a diagram illustrating an interface on an interchangeable head for connecting the interchangeable head to a power adapter, according to an embodiment.
Figure 9:
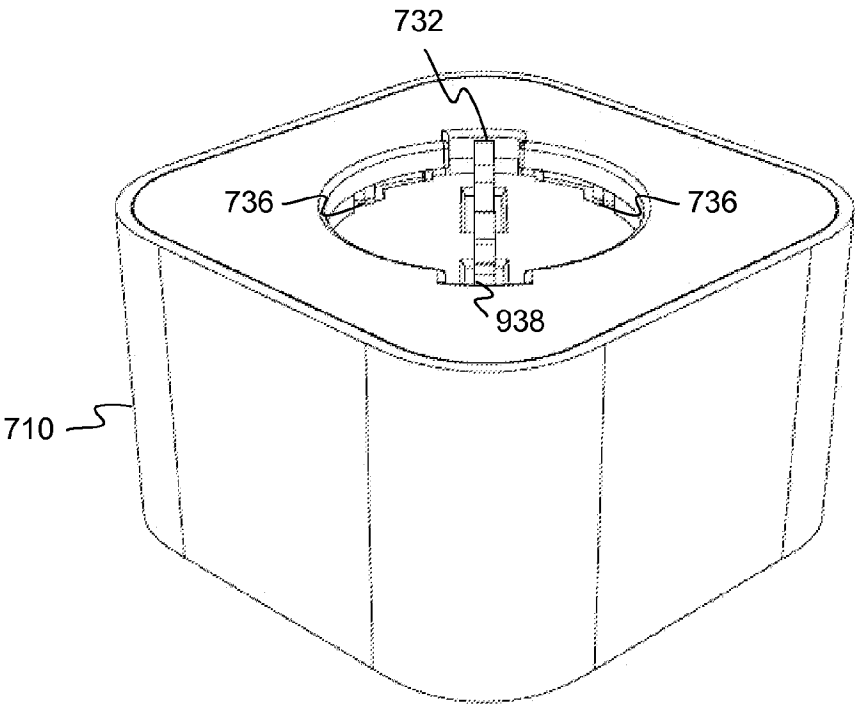
FIG. 9 is a diagram illustrating an interface on a power adapter for connecting the power adapter to an interchangeable head, according to an embodiment.

FIGS. 9 and 10 are diagrams illustrating the interface for connecting the power adapter to an interchangeable head, according to an embodiment of the present invention. Referring to both FIGS. 9 and 10, the various components of the interface are described with respect to how they fit together, in one embodiment. In one embodiment, locking tabs 836 on interchangeable head 820 fit through the notch 938 in the recessed cylindrical portion of the interface on power adapter 710. In one embodiment, interchangeable head 820 has two locking tabs 836 oriented on opposite sides of the cylindrical body and power adapter 720 has two corresponding notches 938, similarly oriented on opposite sides of the recessed cylindrical portion. Upon being inserted through notches 938, the interchangeable head 820, and the attached locking tabs 836 may be rotated in either a clockwise or counter-clockwise direction. In one embodiment, power adapter 710 includes one locking column 736 located within the recessed cylindrical portion on either side of each notch 938. Locking tabs 936 may depress the spring loaded locking columns 736, causing the cylindrical portion of the locking columns 736 to fit within the center portion of the semi-circular locking tabs 836. The force of the spring causes the locking columns 736 to remain engaged with the locking tabs 936, holding the interchangeable head 820 in place. In one embodiment, the interchangeable head 820 may be rotated so that the locking tabs 936 pass back across the notches 938 to engage the locking columns 736 on the opposite side, without removing interchangeable head 820 from the power adapter 710. This may allow a 90 degree rotation of prongs on the interchangeable head 820 with respect to the power adapter 710. In one embodiment, interchangeable head 820 may be removed from power adapter 710, rotated 180 degrees and reattached, such that each locking tab 836 is now inserted through the opposite notch 938. This may allow for two additional orientations of the prongs.

In one embodiment, at the same time that locking tabs 936 are inserted into notches 938, electrical contacts 732 on power adapter 710 may be inserted into gaps 1040 in the cylindrical body on interchangeable head 820. In one embodiment, the electrical contacts 732 are "L" shaped and the gaps 1040 are "Y" shaped. The "Y" shaped gaps may allow the electrical contacts 732 to be inserted and rotated along with the entire interchangeable head 820 into one of the locking positions described above. In the locking positions, the electrical contacts 732 may contact electrical contacts 832 disposed within the cylindrical body on interchangeable head 820. The "Y" shaped gaps 1040 may also prevent accidental contact with the electrical contacts 832 by some other object such as a user's finger. The "Y" shape allows only the "L" shaped electrical contacts 732 to be inserted. In other embodiments, the electrical contacts 732 and gaps 1040 may have some other shapes.

Figure 11:
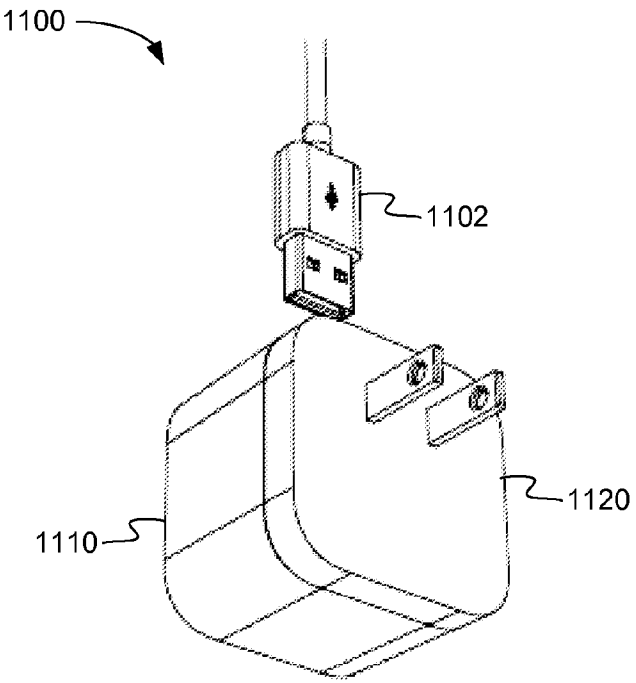
FIG. 11 is a diagram illustrating a power adapter with interchangeable heads with a cable port aligned on top of the power adapter, according to an embodiment.

FIG. 11 is a diagram illustrating a power adapter with interchangeable heads with a cable port aligned on top of the power adapter, according to an embodiment. In one embodiment, apparatus 1100 includes power adapter 1110 and interchangeable head 1120. In the illustrated embodiment, a cable port is located on top of power adapter 1110 relative to the orientation of interchangeable head 1120. Cable 1102, which may be a USB cable, an HDMI cable, or other cable, may be plugged into the cable port on power adapter 1110 so that power may be provided to an attached electronic device.

Figure 12:
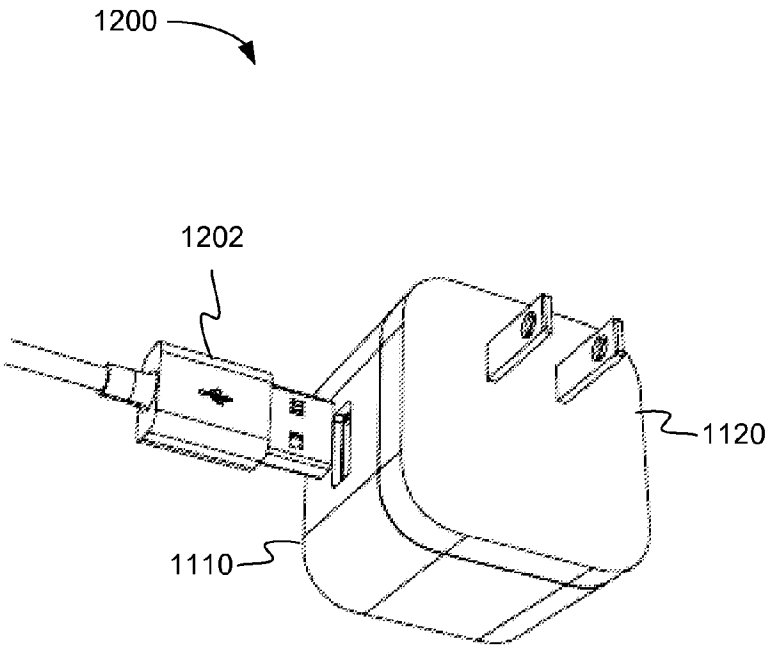
FIG. 12 is a diagram illustrating a power adapter with interchangeable heads with a cable port aligned on the side of the power adapter, according to an embodiment.

FIG. 12 is a diagram illustrating a power adapter with interchangeable heads with a cable port aligned on the side of the power adapter, according to an embodiment. In one embodiment, apparatus 1200 includes power adapter 1110 and interchangeable head 1120. In the illustrated embodiment, the cable port is located on the side of power adapter 1110 relative to the orientation of interchangeable head 1120. The interface, such as interfaces 700 and 800 between power adapter 1110 and interchangeable head 1120 allow a number of different orientations. As such, USB cable 1202 may be plugged into the side cable port on power adapter 1110 so that power may be provided to an attached electronic device. In one embodiment, interchangeable head 1120 may be disengaged from power adapter 1110, removed, rotated, and reengaged with power adapter 1110 in this new orientation. In another embodiment, however, interchangeable head 1120 may be rotated with respect to power adapter 1110 from the orientation shown in FIG. 11 to the orientation shown in FIG. 12 without being disengaged or removed from power adapter 1110.

Figure 13:
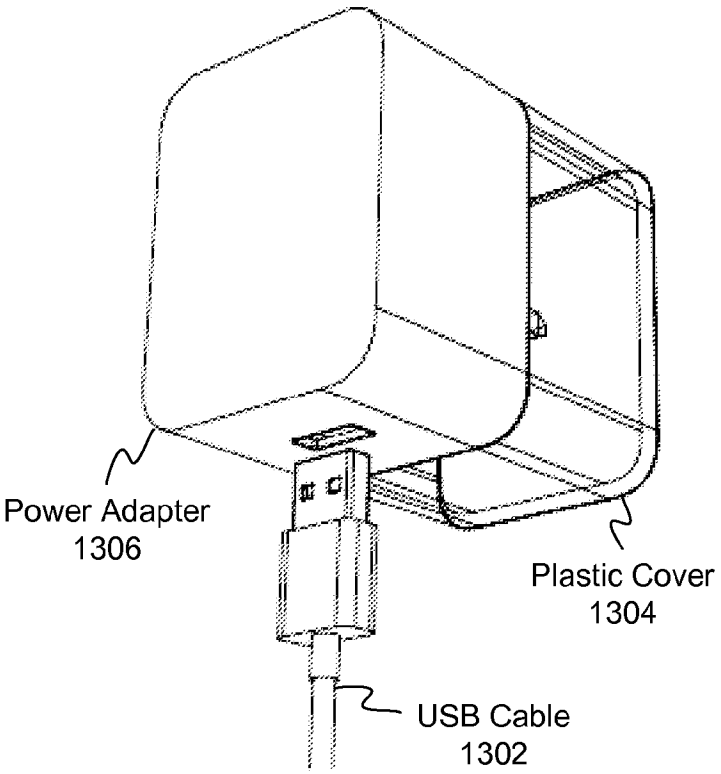
FIG. 13 is a diagram illustrating a cover to protect the prongs of a power adapter with interchangeable heads, according to an embodiment.

FIG. 13 is a diagram illustrating a cover to protect the prongs of a power adapter with interchangeable heads, according to an embodiment. In one embodiment, the prongs extending from the interchangeable head connected to power adapter 1306 are fixed in place. The fixed prongs may be non-removable from the interchangeable head (although the interchangeable head remains removable from the power adapter 1306), nor may they be foldable. In this embodiment, there exists the potential for damage to the prongs or for the prongs to damage other items, such as for example, another product or device, the lining of a bag or briefcase, etc., when the power adapter 1306 is not in use. In one embodiment, a protective cover 1304 may be designed to fit over the prongs to protect and shield the prongs when not in use. The protective cover 1304 may be made, for example, from a plastic, or some other protective material. In one embodiment, the protective cover 1304 may fit over the edge of the interchangeable head and/or the power adapter 1306. In another embodiment, the protective cover 1304 may fit only over the prongs of the interchangeable head. In one embodiment, a USB cable 1302 may still fit into a cable port of power adapter 1306 while protective cover 1304 is attached to cover the prongs.

Figure 14:
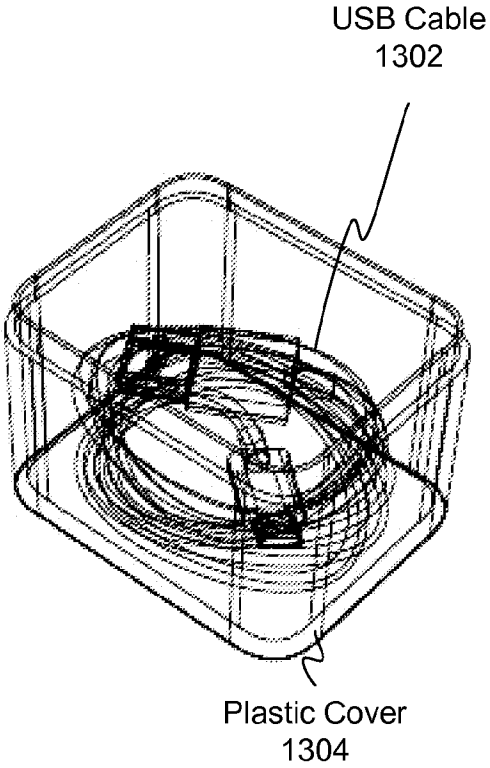
FIG. 14 is a diagram illustrating a cover to store a cable for a power adapter with interchangeable heads, according to an embodiment.

FIG. 14 is a diagram illustrating a cover to store a cable for a power adapter with interchangeable heads, according to an embodiment. In one embodiment, the same protective cover 1304 that is used to protect the prongs on power adapter 1306 may also be used as a cable management system. When not attached to power adapter 1306 to protect the prongs, the protective cover 1304 may be used to store USB cable 1302. When USB cable 1302 is not attached to power adapter 1306, USB cable 1302 may be rolled up and stored in protective cover 1304. In one embodiment, protective cover 1304 may be large enough so that it still may be attached to power adapter 1306, over the prongs, while USB cable 1302 is stored within the protective cover 1304. In another embodiment, the USB cable 1302 may only be stored in protective cover 1304 when protective cover 1304 is not attached to power adapter 1306, as illustrated in FIG. 14. The cable management property of protective cover 1304 may protect the USB cable 1302 when not in use and protect the USB cable 1302, for example, while traveling.

Figure 15:
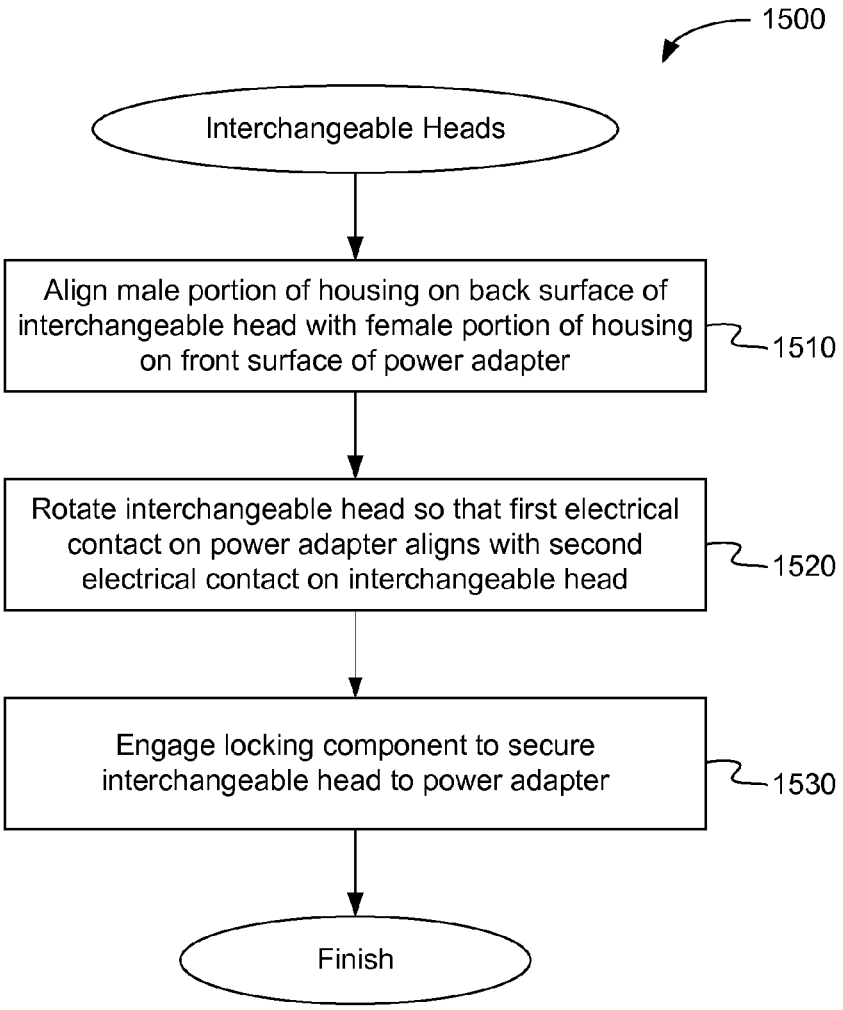
FIG. 15 is a flow diagram illustrating a method for connecting a power adapter to an interchangeable head, according to an embodiment.

FIG. 15 is a flow diagram illustrating a method for connecting a power adapter to an interchangeable head, according to an embodiment. The method 1500 may be performed by the power adapter and interchangeable heads described above with respect to FIGS. 1-14. In one embodiment, the method 1500 allows a connection between a power adapter and an interchangeable head.

Referring to FIG. 15, at block 1510, method 1500 aligns a male portion of a housing 834 on a back surface of an interchangeable head 820 with a female portion of the housing 734 on a front surface of a power adapter 710. In one embodiment, the cylindrical void of geometric housing 734 has one or more notches in the side used to align one or more locking tabs of locking component 836 on interchangeable head 820. The notches effectively limit the orientations in which geometric housing 834 may fit into geometric housing 734. By aligning the locking tabs with the notches, the male portion of the housing 834 may be inserted into the female portion of the housing 734, forming a connection between the interchangeable head 820 and the power adapter 710. In other embodiments, the notches are not present and the cylindrical void of geometric housing 734 is substantially uniform at the top surface. In this case, there is no limit to the different orientations in which geometric housing 834 may fit into geometric housing 734.

At block, 1520, method 1500 rotates the interchangeable head so that a first electrical contact on the power adapter aligns with a second electrical contact on the interchangeable head. As described above, in one embodiment, geometric housing 834 may have one or more gaps or holes within the surface to accommodate electrical contacts 732 from power adapter 710. Electrical contacts 732 on power adapter 710 may be exposed contacts. Electrical contacts 832 on interchangeable head 820 may be covered contacts disposed within geometric housing 834. In one embodiment, electrical contacts 832 may have a substantially flat or planar shape to enable contact with electrical contacts 732. Electrical contacts 732 may be shaped to fit within the gap or hole in the surface of geometric housing 834 in order to contact electrical contacts 832, which are disposed beneath the surface of geometric housing 834, upon rotation of interchangeable head 820 or power adapter 710.

At block 1530, method 1500 engages a locking component to secure the interchangeable head to the power adapter. In one embodiment, locking component 736 includes one or more spring loaded locking columns disposed within the cylindrical void of geometric housing 734. Locking component 836 of interchangeable adapter 820 may include one or more locking tabs extending from the cylindrical body of geometric housing 834. As described above, when geometric housing 834 is inserted into geometric housing 734, the locking tabs of locking component 836 may fit into the notches of geometric housing 734. As interchangeable head 820 is rotated either clockwise or counterclockwise, upon reaching a stopping point (e.g., a rotation of 45 degrees), the locking tabs of locking component 836 may engage the spring loaded locking columns of locking component 736. The spring loaded locking columns of locking component 736 may hold the locking tabs of locking component 836 in place, thereby securing interchangeable head 820 in place, until a sufficient force is applied to overcome the springs.

In the above description, numerous details are set forth. It will be apparent, however, to one of ordinary skill in the art having the benefit of this disclosure, that embodiments of the invention may be practiced without these specific details. In some instances, well-known structures and devices are shown in block diagram form, rather than in detail, in order to avoid obscuring the description.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. An apparatus comprising:

a power adapter comprising:

a housing having a recessed cylindrical portion that extends from a first face of the housing, the recessed cylindrical portion comprising a first plurality of locking columns and a second plurality of locking columns, wherein the locking columns are spring-loaded and configured to exert a force directed at least partially toward a center of the recessed cylindrical portion;

a cable port disposed on one side of the power adapter;

a first plurality of electrical contacts disposed within the cylindrical portion of the housing; and a power conversion circuit coupled to the cable port and configured to convert an input power received at the plurality of electrical contacts to an output power, and provide the output power to the cable port; and an interchangeable head comprising:

a plurality of prongs protruding from a surface of the interchangeable head;

a second plurality of electrical contacts, the second plurality of electrical contacts electrically coupled to the plurality of prongs, and configured to engage the first plurality of electrical contacts of the power adapter to provide the input power to the power conversion circuit; and a cylindrical body configured to fit within the recessed cylindrical portion of the housing of the power adapter, the cylindrical body having a plurality of locking tabs to engage the first plurality of locking columns when the interchangeable head is rotated in a first direction into a first locking position and to engage the second plurality of locking columns when the interchangeable head is rotated in a second direction into a second locking position, the plurality of locking tabs to receive the locking columns to hold the interchangeable head in place.

2. The apparatus of claim 1, wherein the cable port is configured to engage a removable power cable configured to couple the power adapter to a device.

3. The apparatus of claim 1, wherein the interchangeable head is configured to couple to the power adapter in a plurality of orientations, wherein the interchangeable head is configured to rotate from a first orientation corresponding to the first locking position to a second orientation corresponding to the second locking position without the cylindrical body being removed from the recessed cylindrical portion of the housing.

4. The apparatus of claim 1, wherein the interchangeable head comprises a plurality of electrical contacts disposed within the cylindrical body and covered, at least in part, by the cylindrical body.

5. The apparatus of claim 4, wherein the plurality of electrical contacts of the power adapter comprises substantially hooked electrical contacts configured to enter an opening in the cylindrical body and to engage the electrical contacts of the interchangeable head.

6. An apparatus comprising:

a power adapter comprising:

a housing having a recessed cylindrical portion disposed within a first side of the power adapter, the recessed cylindrical portion comprising a plurality of locking columns;

a cable port disposed on a second side of the power adapter; and a first plurality of electrical contacts disposed within the recessed cylindrical portion of the housing; and an removable head comprising:

a plurality of prongs protruding from a first surface of the removable head;

a cylindrical body protruding from a second surface opposite the first surface, the cylindrical body to fit within the recessed cylindrical portion of the housing of the power adapter in an assembly position; and a plurality of locking tabs extending from the cylindrical body to engage the plurality of locking columns when the removable head is rotated into a locking position to hold the removable head in place, the removable head configured to couple with the power adapter in a plurality of orientations, wherein the removable head is configured to rotate from one orientation to another without the cylindrical body being removed from the cylindrical housing.

7. The apparatus of claim 6, wherein the plurality of locking columns comprises spring-loaded locking columns disposed along a wall of the recessed cylindrical portion of the housing.

8. The apparatus of claim 6, wherein the power adapter comprises a power conversion circuit to convert an input power from one of a plurality of alternating current (AC) power systems to an output power used by a device coupled to the cable port.

9. The apparatus of claim 6, wherein the removable head comprises a second plurality of electrical contacts disposed within the cylindrical body and covered, at least in part, by the cylindrical body.

10. The apparatus of claim 9, wherein the housing comprises a plurality of notches, wherein the plurality of locking tabs on the cylindrical body are configured to pass through the plurality of notches and rotate in a first direction to a first orientation where one of the plurality of locking tabs engages a first spring-loaded locking column and rotate in a second direction to a second orientation wherein the one of the plurality of locking tabs engages a second spring-loaded locking column.

11. The apparatus of claim 6, wherein the cable port is configured to engage a removable power cable configured to couple the power adapter to a device.

12. The apparatus of claim 11, further comprising:

a protective cover configured to couple with the removable head, the protective cover to shield the plurality of prongs protruding from the surface of the removable head.

13. The apparatus of claim 12, wherein the protective cover is configured to store the removable power cable when the removable power cable is not in use.

14. The apparatus of claim 12, wherein the first plurality of electrical contacts comprises substantially hooked electrical contacts configured to enter an opening in the cylindrical body to contact the second plurality of electrical contacts of the removable head.

15. An apparatus comprising:

a power adapter comprising:

a housing having a recessed cylindrical portion that extends from a first face of the housing, the recessed cylindrical portion comprising a plurality of locking columns;

a cable port disposed on one side of the power adapter; and a first plurality of electrical contacts disposed within the cylindrical portion of the housing;

an removable head comprising:

a plurality of prongs protruding from a surface of the removable head;

a second plurality of electrical contacts, the second plurality of electrical contacts electrically coupled to the plurality of prongs and configured to engage the first plurality of electrical contacts of the power adapter; and a cylindrical body configured to fit within the recessed cylindrical portion of the housing of the power adapter, the cylindrical body having a plurality of locking tabs to engage the plurality of locking columns to hold the removable head in place; and a protective cover configured to couple with the removable head, the protective cover to shield the plurality of prongs protruding from the surface of the removable head.

16. The apparatus of claim 15, wherein the removable head is configured to couple to the power adapter in a plurality of orientations.

17. The apparatus of claim 15, wherein the removable head is configured to rotate from a first orientation corresponding to a first locking position to a second orientation corresponding to a second locking position without the cylindrical body being removed from the recessed cylindrical portion of the housing.

18. The apparatus of claim 15, wherein the housing comprises a plurality of notches, wherein the plurality of locking tabs on the cylindrical body are configured to fit in the plurality of notches and rotate in a first direction to a first orientation where one of the plurality of locking tabs engages a first locking column and rotate in a second direction to a second orientation wherein the one of the plurality of locking tabs engages a second locking column.

19. The apparatus of claim 15, wherein the cable port is configured to engage a removable power cable configured to couple the power adapter to a device.

20. The apparatus of claim 19, wherein the protective cover is configured to store the removable power cable when the removable power cable is not in use.

* * * * *